US006854428B1

(12) United States Patent
Hotton et al.

(10) Patent No.: US 6,854,428 B1
(45) Date of Patent: Feb. 15, 2005

(54) WATER HEATER WITH NORMALLY CLOSED AIR INLET DAMPER

(75) Inventors: Bruce A. Hotton, Montgomery, AL (US); Troy E. Trant, Letohatchee, AL (US); John H. Scanlon, Montgomery, AL (US); Gordon W. Stretch, Columbia, SC (US)

(73) Assignee: The Water Heater Industry Joint Research and Development Consortium, Rio Verde, AZ (US)

( * ) Notice: Subject to any disclaimer, the term of this patent is extended or adjusted under 35 U.S.C. 154(b) by 0 days.

(21) Appl. No.: 10/874,044

(22) Filed: Jun. 22, 2004

(51) Int. Cl.[7] ..... F22B 5/04
(52) U.S. Cl. ..... 122/14.31; 122/14.21
(58) Field of Search ..... 122/14.31, 14.2, 122/14.21

(56) References Cited

U.S. PATENT DOCUMENTS

| | | | | |
|---|---|---|---|---|
| 1,877,580 | A | | 9/1932 | Parker |
| 2,349,876 | A | | 5/1944 | Martin |
| 3,580,238 | A | | 5/1971 | Diehl |
| 4,369,718 | A | | 1/1983 | Eppinger et al. |
| 4,486,165 | A | | 12/1984 | Usami et al. |
| 4,586,893 | A | | 5/1986 | Somerville et al. |
| 4,664,096 | A | | 5/1987 | Narang |
| 4,777,932 | A | | 10/1988 | Pennington |
| 4,869,232 | A | | 9/1989 | Narang |
| 4,981,262 | A | | 1/1991 | Jackson |
| 5,039,006 | A | | 8/1991 | Habegger |
| 5,056,500 | A | | 10/1991 | Evens |
| 6,035,812 | A | | 3/2000 | Harrigill et al. |
| 6,161,506 | A | | 12/2000 | Hanson |
| 6,295,952 | B1 | * | 10/2001 | Reynolds et al. ..... 122/14.31 |
| 6,390,028 | B1 | * | 5/2002 | Langmead et al. ..... 122/14.2 |
| 6,412,447 | B1 | * | 7/2002 | Trant et al. ..... 122/14.21 |
| 6,497,200 | B2 | | 12/2002 | Stretch et al. |
| 2003/0000481 | A1 | | 1/2003 | Stretch et al. |
| 2003/0196609 | A1 | | 10/2003 | Stretch et al. |

* cited by examiner

*Primary Examiner*—Gregory Wilson
(74) *Attorney, Agent, or Firm*—Konneker & Smith, P.C.

(57) ABSTRACT

A fuel-fired, power vented water heater has a combustion chamber with an outer wall portion defined by an arrestor plate in which flame quenching air inlet openings are formed. All combustion air entering the combustion chamber must first pass through an air inlet plenum extending outwardly from the arrestor plate and then pass inwardly through the flame quenching openings into the combustion chamber. The air inlet plenum is provided with a normally closed inlet damper which automatically closes during non-firing periods of the water heater to prevent passage of combustion air (and extraneous flammable vapors, if present, adjacent the water heater) into the combustion chamber, and opens during firing periods of the water heater to permit operative combustion air delivery to the combustion chamber.

20 Claims, 2 Drawing Sheets

WATER HEATER WITH NORMALLY CLOSED AIR INLET DAMPER

BACKGROUND OF THE INVENTION

The present invention generally relates to fuel-fired heating appliances and. In a preferred embodiment thereof, more particularly relates to a fuel-fired water heater provided with a normally closed air inlet damper structure which, during non-firing periods of the water heater, functions to prevent entry of extraneous flammable vapors into the water heater combustion chamber through perforations in a flame arrestor wall portion thereof.

In a conventional fuel-fired, power vented water heater an intermittent pilot ignition structure within the water heater's combustion chamber is utilized to ignite the main burner therein when an associated thermostat calls for heat to be delivered to the water stored in the tank portion of the water heater. During idle, non-firing periods of the water heater (when both the main burner and the associated pilot ignition structure are not operating) ambient air near the combustion air inlet portion of the water heater may be drawn into the combustion chamber by, for example, a natural draft effect within the flue portion of the water heater.

This incoming combustion air may carry with it extraneous flammable vapors if they are present adjacent the water heater. When the next demand for heat occurs, and the pilot structure is ignited to start the main burner, an undesirably hard ignition may occur in the combustion chamber when a buildup of such flammable vapors occurs therein. It would thus be desirable to provide this type of fuel-fired water heater with apparatus for preventing a combustion chamber inflow of combustion air and extraneous flammable vapors during non-firing periods of the water heater. It is to this goal that the present invention is directed.

SUMMARY OF THE INVENTION

In carrying out principles of the present invention, in accordance with a preferred embodiment thereof, a fuel-fired heating apparatus is provided which has a combustion chamber with an outer wall portion with flame quenching inlet openings disposed therein. A fuel burner is disposed in the combustion chamber and is operative to receive fuel from a source thereof and combust the received fuel with combustion air entering the combustion chamber via the flame quenching openings.

The fuel-fired heating apparatus is also provided with air flow control apparatus operative to permit combustion air to enter the combustion chamber through the flame quenching inlet openings in response to firing of the heating apparatus, and preclude combustion air inflow into the combustion chamber in response to cessation of firing of the heating apparatus. Preferably, the air flow control apparatus is further operative to cause all combustion air entering the combustion chamber to pass inwardly through the flame quenching inlet openings. The preclusion of combustion air inflow to the combustion chamber during non-firing periods of the heating apparatus prevents extraneous flammable vapors which may be present adjacent the apparatus from migrating into the combustion chamber with combustion air prior to the next firing cycle of the heating apparatus.

In one representatively illustrated embodiment thereof, the fuel-fired heating apparatus is a power vented water heater having an elevated combustion chamber bottom outer wall in which an arrestor plate having flame quenching inlet openings is disposed. An enclosed inlet plenum box extends downwardly from this bottom combustion chamber wall, from around the periphery of the arrestor plate, and has a side wall opening therein in which a normally closed barometric damper is pivotally mounted. When the water heater is being fired, and its draft inducer is operating, the damper is automatically opened to admit combustion air into the combustion chamber sequentially through the interior of the plenum box and the arrestor plate flame quenching openings. All of the combustion air utilized by the water heater must pass through the plenum box and the flame quenching openings. In response to the cessation of the firing of the water heater, the damper closes and precludes combustion air, and extraneous flammable vapors if present adjacent the water heater, from migrating into the combustion chamber through the flame quenching openings during stand-by, non-firing periods of the water heater.

In a representatively illustrated alternate embodiment of the power vented water heater, the plenum box and normally closed barometric damper associated therewith are respectively replaced with (1) a skirt wall extending downwardly from the periphery of the bottom combustion chamber wall and forming a combustion air inlet plenum underlying the combustion chamber, the skirt wall having a side inlet opening therein, and (2) a normally closed motorized damper installed in an inlet duct extending outwardly from the side inlet opening and having an open outer end. The motorized damper is operatively connected to the water heater draft inducer fan in a manner such that as the water heater is being fired and the draft inducer fan is running, the damper is automatically opened to admit combustion air to the combustion chamber sequentially through the skirt wall plenum and the flame quenching inlet openings. When the draft inducer fan is shut down in conjunction with cessation of firing of the water heater, the motorized damper automatically closes to thereby preclude combustion air, and extraneous flammable vapors if present adjacent the water heater, from migrating into the combustion chamber through the flame quenching openings during stand-by, non-firing periods of the water heater.

DETAILED DESCRIPTION

Figure 2:
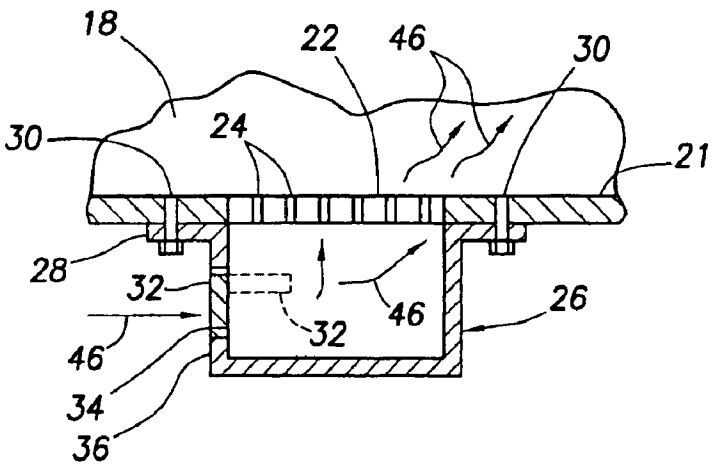
FIG. 2 is an enlarged scale cross-sectional view through the water heater taken along line 2—2 of FIG. 1.
Figure 1:
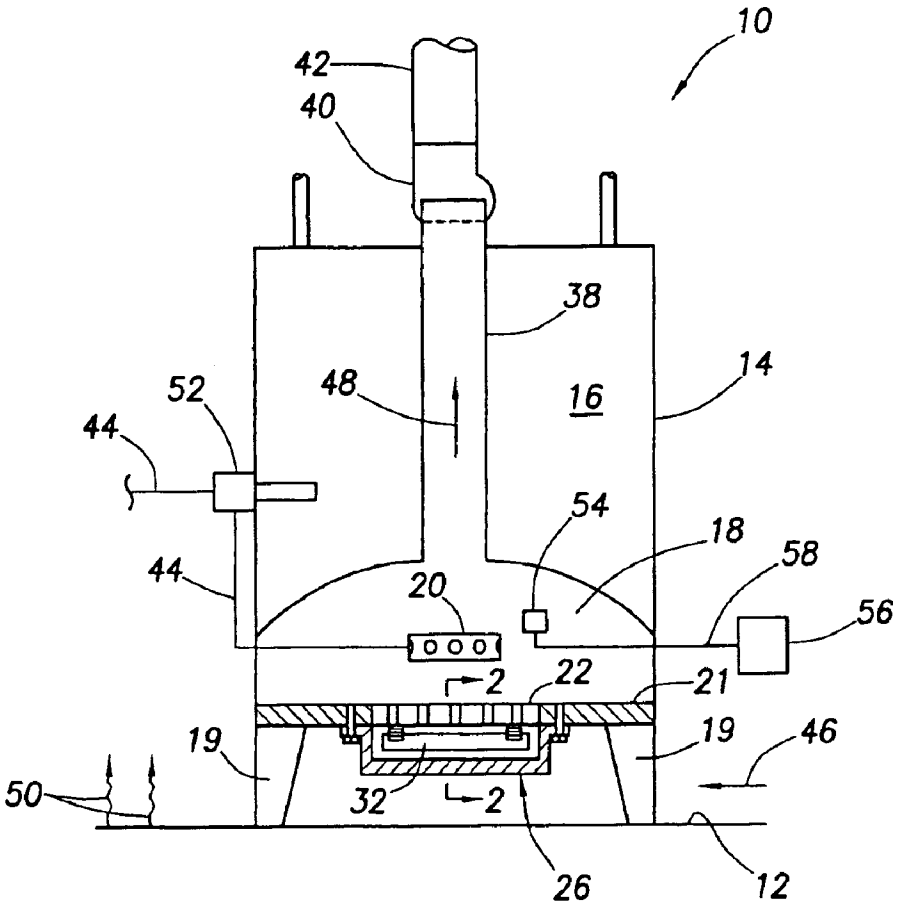
FIG. 1 is a schematic cross-sectional view through a specially designed fuel-fired water heater embodying principles of the present invention.

Cross-sectionally illustrated in schematic form in FIGS. 1 and 2, and representatively embodying principles of the present invention, is a power-vented, gas-fired water heater 10 resting on a floor 12 and having a tank portion 14 in which a quantity of heated water 16 is stored for on-demand delivery to hot water-utilizing plumbing fixtures such as sinks, showers, bathtubs, dishwashers and the like. A combustion chamber 18 is disposed beneath the tank 14, is elevated relative to the floor 12 by a spaced series of depending support legs 19, and has a fuel burner structure 20 operatively disposed therein. The bottom wall 21 of the combustion chamber 18 has an arrestor plate 22 mounted in a central portion of the wall 21. The arrestor plate 22 has a spaced series of flame quenching air inlet openings 24 therein.

Mounted on the bottom side of the combustion chamber bottom wall 21, and downwardly overlying the perforated flame arrestor plate portion 22 thereof, is an open-topped rectangular combustion air inlet plenum box 26 with a mounting flange 28 secured to the bottom side of the combustion chamber bottom wall with suitable fasteners such as screws 30. An inwardly pivotable, normally closed air inlet damper 32 is operatively connected in an opening 34 of a vertical side wall portion 36 of the plenum box 26, and is pivotal between a vertical, solid line closed position in which it blocks the wall opening 34, and an inwardly pivoted, dotted line position in which it uncovers the wall opening 34.

A flue 38 extends upwardly from the combustion chamber 18, through the water 16 in the tank 14, and is connected at its upper end to the inlet of a draft inducer fan 40 suitably mounted on the top end of the body of the water heater 10. Fan 40 has an outlet connected to a vent stack 42.

During firing of the water heater 10, gas is supplied to the burner 20 via a gas supply line 44, and the inducer fan 40 is operated to create a forced draft through the combustion chamber 18 and the flue 38. This forced draft exerts, through the arrestor plate openings 24, a negative pressure within the interior of the combustion air intake plenum box 26 and pivots the damper 32 from its solid line, normally closed position to its dotted line, open position shown in FIG. 2. With the damper 32 open and the inducer fan 40 running, ambient combustion air 46 is drawn into the combustion chamber 18 sequentially via the plenum box opening 34, the interior of the plenum box 26, and the arrestor plate openings 24. The air 46 entering the combustion chamber 18 is combusted with gas being discharged from the burner 20 to create hot combustion products 48 which flow upwardly through the flue 38 and are discharged into the vent stack 42 by the inducer fan 40. Combustion heat from the combustion products 48 is operatively transferred to the tank water 16 through the flue 38.

In a conventional manner, during firing of the water heater 10, the arrestor plate flame quenching openings 24 serve to permit flammable vapors 50 (created, for example, by a flammable liquid spill adjacent the water heater 10), together with combustion air 46, to pass upwardly through arrestor plate openings 24 into the combustion chamber 18 and be burned therein, but prevent the downward discharge of flames through the arrestor plate openings 24.

According to a key feature of this invention, the normally closed damper 32 installed in the air inlet box 26 remains closed during non-firing (or "off-duty") periods of the water heater 10 and thus prevents ambient air 46 and/or flammable vapors 50 from migrating into the combustion chamber 18 (due, for example, to a natural draft in the flue 38 when the fan 40 is not operating) through the flame arrestor openings 24 and building up for a subsequent ignition when the burner 20 is lit for a later heating cycle. Since all of the combustion air 46 (and flammable vapors 50 as the case may be) entering the combustion chamber 18 must flow through the arrestor plate inlet openings 24 downwardly covered by the plenum box 26, closure of the damper 32 during non-firing of the water heater 10 prevents entry of air 46 and flammable vapors 50 into the combustion chamber 18, thereby preventing a build-up of a combustible mixture of air and fumes in the combustion chamber 18 during non-firing or "idle" periods of the water heater 10.

When the water heater 10 is being fired, the representatively barometric damper 32 is moved to its dotted line open position to permit combustion air 46 to be drawn into the combustion chamber 18 through the arrestor plate openings 24 otherwise blocked by the body of the air plenum box 26. Alternatively, this damper opening may be electrically effected by a non-illustrated electrical control line run from the motor of the fan 40 to an electric operating motor portion (not shown) of the damper 32. A variety of other techniques for opening the normally closed damper 32 when the water heater 10 is being operated may be employed if desired. For example, stack pressure could be sensed and used to responsively open the damper 32.

As schematically depicted in FIG. 1, the water heater 10 also includes a normally closed thermostatic gas valve 52 interposed in the gas supply line 44, mounted on the tank 14 and operative to sense the temperature of the tank water 16, an intermittently operated pilot igniter 54 suitably supported within the combustion chamber 18 near the fuel burner 20, and a conventional, schematically illustrated control system 56 operatively associated with the valve 52, the draft inducer fan 40 and, by an electrical line 58, to the pilot igniter 54.

With the water heater 10 in its non-firing or stand-by state, firing of the water heater is initiated by the thermostatic gas valve 52 sensing that heat needs to be added to the tank water 16 and responsively opening to supply gas to the burner 20. In conjunction with this valve opening, the control system 56 operates the pilot igniter 54 to light the burner 20, and starts the draft inducer fan 40 to draw the hot combustion products 48 upwardly through the flue 48 and cause the damper 32 to open and admit combustion air 46 into the combustion chamber through the arrestor plate openings 24 as previously described.

When the demand for heat is satisfied, the valve 52 closes to shut down the burner 20, and the control system shuts off the draft inducer fan 40 to thereby return the water heater 10 to its non-firing or stand-by state and automatically cause the damper 32 to return to its normally closed position in which it prevents flammable vapor 50 (if present) from migrating into the combustion chamber 18 through the arrestor plate openings 24 and being ignited by the pilot igniter 54 at the onset of the next water heater firing cycle.

As can be seen, the air plenum box 26 and the associated normally closed damper 32 define in the water heater 10 air flow control apparatus operative to cause all combustion air 46 entering the combustion chamber 18 to pass inwardly through the flame quenching openings 24, the air flow control apparatus permitting the combustion air 46 (and flammable vapors 50 if present) to enter the combustion chamber 18 in response to firing of the water heater 10, and precluding combustion air 46 (and flammable vapors 50 if present) from entering the combustion chamber 18 in response to cessation of firing of the water heater 10.

Figure 3:
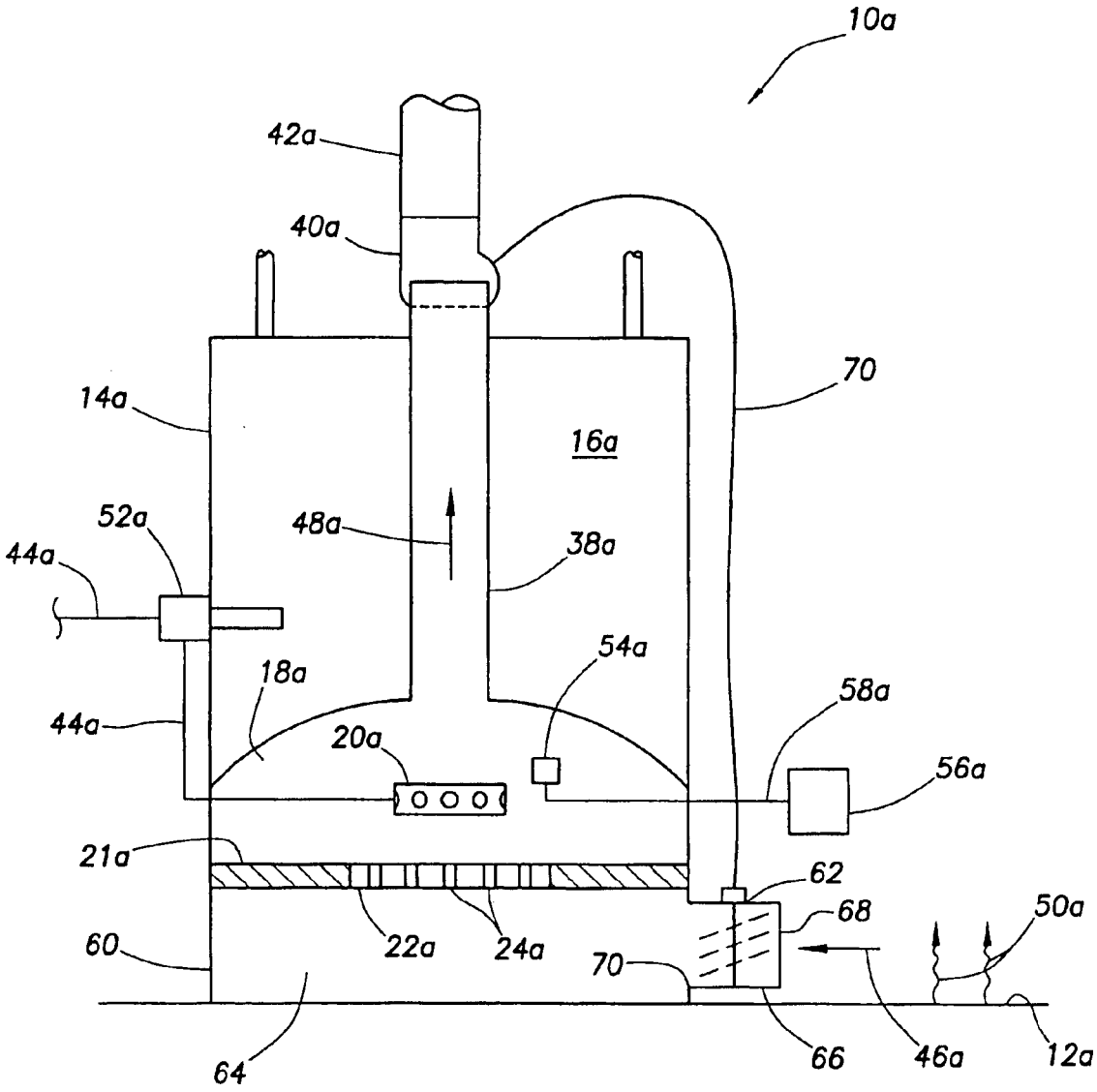
FIG. 3 is a schematic cross-sectional view through an alternate embodiment of the FIG. 1 water heater.

Cross-sectionally illustrated in schematic form in FIG. 3 is an alternate embodiment 10*a* of the previously described water heater 10. For the purpose of ready comparison between the water heater embodiments 10 and 10*a*, components in the water heater 10*a* similar to those in the water heater 10 have been given the same reference numerals to which the subscripts "a" have been added.

In the water heater 10*a* the previously described plenum box 26 and associated normally closed barometric inlet damper 32 (see FIG. 2) are respectively replaced with (1) a peripheral skirt wall 60 extending downwardly from the periphery of the bottom combustion chamber wall 21, and (2) a normally closed motorized electric damper structure 62. The lower end of the peripheral skirt wall 62 rests on the floor 12*a*, supports the bottom combustion chamber wall 21*a* in an elevated relationship therewith, and defines an air inlet plenum 64 that underlies the elevated combustion chamber 18*a*. A combustion air intake duct 66 having an open outer end 68 extends horizontally outwardly from an opening 70 in the skirt wall 60, with the normally closed motorized damper structure 62 being operatively installed in the duct 66.

The normally closed motorized damper structure 62 is operatively interlocked with the draft inducer fan 40*a*, representatively via electric lines 70, in a manner such that when the water heater 10*a* is being fired, and the fan 40*a* is running, the normally closed damper structure 62 is opened to admit combustion air 46*a* into the combustion chamber 18*a* sequentially through the duct 66, the plenum 64 and the arrestor plate flame quenching openings 24*a*, and when the water heater 10*a* is in a non-firing, stand-by mode the damper structure 62 automatically returns to its normally closed position in which it precludes the entry of combustion air 46*a*, and flammable vapors 50*a* if present adjacent the lower end of the water heater 10*a*, into the combustion chamber 18*a*. As can be seen, as in the case of the previously described water heater 10, the air flow control apparatus of the water heater 10*a* (representatively the plenum 64, the duct 66 and the damper structure 62) functions to permit the combustion air 46*a* (and flammable vapors 50*a* if present) to enter the combustion chamber 18*a* in response to firing of the water heater 10*a*, and preclude combustion air 46*a* (and flammable vapors 50*a* if present) from entering the combustion chamber 18*a* In response to cessation of firing of the water heater 10*a*.

It should be noted that the barometric damper 32 shown in FIG. 2 could be replaced with other types of damper structures, such as the motorized damper structure 62 shown in FIG. 3, if desired. Similarly, the motorized damper structure 62 shown in FIG. 3 could be replaced with other types of damper structures, such as the barometric damper 32 shown in FIG. 2. Additional types of combustion air intake shutoff techniques such as, for example, closing a damper in response to sensed stack pressure, could be utilized in either of the representatively illustrated water heaters 10 and 10*a*.

Moreover, while principles of the present invention have been representatively illustrated and described as being incorporated in a fuel-fired power vented water heater, they could also be advantageously utilized in other types of fuel-fired heating apparatus such as, for example but not by way of limitation, natural draft fuel-fired water heaters. Additionally, while the combustion air inlet control damper structures 32 and 62 representatively illustrated and described herein are normally closed damper structures, it will be readily appreciated by those of skill in this particular art that normally open damper structures could also be utilized if they were controlled so as to be open during firing of the water heater or other fuel-fired heating appliance and closed during stand-by, non-firing periods thereof.

The foregoing detailed description is to be clearly understood as being given by way of illustration and example only, the spirit and scope of the present invention being limited solely by the appended claims.

What is claimed is:

1. Fuel-fired heating apparatus comprising:

a combustion chamber having an outer wall portion with flame quenching inlet openings disposed therein;

a burner disposed in said combustion chamber and operative to receive fuel from a source thereof and combust the received fuel with combustion air entering said combustion chamber via said flame quenching inlet openings; and air flow control apparatus operative to permit combustion air to enter said combustion chamber through said flame quenching inlet openings in response to firing of said heating apparatus, and preclude combustion air inflow into said combustion chamber in response to cessation of firing of said heating apparatus.

2. The fuel-fired heating apparatus of claim 1 wherein:

said air flow control apparatus is further operative to cause all combustion air entering said combustion chamber to pass inwardly through said flame quenching inlet openings.

3. The fuel-fired heating apparatus of claim 1 wherein:

said fuel-fired heating apparatus is a water heater.

4. The fuel-fired heating apparatus of claim 3 wherein:

said water heater is a power vented water heater.

5. The fuel-fired heating apparatus of claim 1 wherein said air flow control apparatus includes:

a wall structure defining a plenum external to and communicated with said flame quenching openings, and a damper structure associated with said wall structure and operable to (1) permit air flow through said plenum to said flame quenching openings in response to firing of said fuel-fired heating apparatus, and (2) preclude air flow through said plenum to said flame quenching openings in response to cessation of firing of said fuel-fired heating apparatus.

6. The fuel-fired heating apparatus of claim 5 wherein:

said damper structure is a normally closed damper structure.

7. The fuel-fired heating apparatus of claim 6 wherein:

said outer wall portion of said combustion chamber is defined by an arrestor plate, said wall structure extends generally around the periphery of said arrestor plate and defines an enclosed plenum projecting outwardly from said arrestor plate, said wall structure having an inlet opening therein, and said damper structure is operatively mounted in said inlet opening.

8. The fuel-fired heating apparatus of claim 7 wherein:

said damper structure is a barometric damper.

9. The fuel-fired heating apparatus of claim 8 wherein:

said fuel-fired heating apparatus is a power vented heating apparatus.

10. The fuel-fired heating apparatus of claim 5 wherein:

said outer wall portion of said combustion chamber is a bottom wall of said combustion chamber, said wall structure defining a plenum is a skirt wall extending downwardly from around the periphery of said bottom wall and having a side wall opening, and said damper structure is operative to selectively preclude air flow through said side wall opening.

11. The fuel-fired heating apparatus of claim 10 wherein:

said damper structure is a normally closed damper structure.

12. The fuel-fired heating apparatus of claim 11 wherein:

said damper structure is a motorized damper structure, and said fuel-fired heating apparatus is a power vented heating apparatus having a draft inducer fan coupled to said damper structure in a manner opening it in response to operation of said draft inducer fan.

13. The fuel-fired heating apparatus of claim 12 further comprising:

an air inlet duct extending outwardly from said side wall opening, said motorized damper structure being operatively connected to said air inlet duct.

14. A method of operating a fuel-fired heating apparatus having a combustion chamber, said method comprising the steps of:

forming flame quenching inlet openings in an outer wall portion of said combustion chamber;

causing combustion air to flow into said combustion chamber through said flame quenching inlet openings in response to the initiation of firing of said heating apparatus; and precluding fluid flow into said combustion chamber through said flame quenching inlet openings in response to termination of firing of said heating apparatus.

15. The method of claim 14 wherein:

said causing step is performed in a manner such that combustion air flows into said combustion chamber only through said flame quenching inlet openings.

16. The method of claim 15 wherein:

said method further comprises the step of extending a plenum outwardly from said flame quenching inlet openings, and said causing and precluding steps are performed using a damper structure operative to selectively permit and preclude combustion air flow through said plenum structure to said flame quenching inlet openings.

17. The method of claim 16, wherein:

said causing and precluding steps are performed using a normally closed damper structure openable in response to firing of said fuel-fired heating apparatus.

18. The method of claim 14 wherein:

said causing and precluding steps are performed using a damper structure to regulate flow inwardly through said flame quenching inlet openings.

19. The method of claim 18, wherein:

said causing and precluding steps are performed using a normally closed damper structure to regulate flow inwardly through said flame quenching inlet openings.

20. A fuel-fired water heater comprising:

a tank adapted to hold a quantity of water to be heated;

a combustion chamber disposed at a bottom portion of said tank and having an outer wall with flame quenching openings disposed therein;

a flue communicating with said combustion chamber and extending therefrom upwardly through said tank;

a burner disposed in said combustion chamber and operative to receive fuel from a source thereof and combust the received fuel with combustion air entering said combustion chamber via said flame quenching openings; and air flow control apparatus for controlling combustion air inflow to said combustion chamber, said air flow control apparatus including:

an air inlet plenum extending outwardly from said outer wall and around said flame quenching openings in a manner such that all combustion air entering said combustion chamber flows through said air inlet plenum structure and said flame quenching openings, and a normally closed damper structure operatively connected to said air inlet plenum and (1) being movable to an open position, in which it permits air flow through said air inlet plenum, in response to firing of said water heater, and (2) being movable to an open position, in which it precludes air flow through said air inlet plenum, in response to cessation of firing of said water heater.

* * * * *